US009987849B2

(12) United States Patent
Inada et al.

(10) Patent No.: US 9,987,849 B2
(45) Date of Patent: Jun. 5, 2018

(54) LIQUID EJECTING DEVICE

(71) Applicant: CANON KABUSHIKI KAISHA, Tokyo (JP)

(72) Inventors: Genji Inada, Koshigaya (JP); Yasushi Iijima, Tokyo (JP); Satoshi Kimura, Kawasaki (JP); Yasuhiko Osaki, Yokohama (JP); Kenji Kitabatake, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days. days.

(21) Appl. No.: 15/231,404

(22) Filed: Aug. 8, 2016

(65) Prior Publication Data

US 2017/0050441 A1 Feb. 23, 2017

(30) Foreign Application Priority Data

Aug. 21, 2015 (JP) ..... 2015-163936
Aug. 21, 2015 (JP) ..... 2015-163965

(51) Int. Cl.
*B41J 2/175* (2006.01)
*B41J 29/02* (2006.01)

(52) U.S. Cl.
CPC ..... *B41J 2/17509* (2013.01); *B41J 2/17513* (2013.01); *B41J 2/17553* (2013.01); *B41J 29/02* (2013.01)

(58) Field of Classification Search
CPC ..... B41J 2/055; B41J 2/175; B41J 2/17556
USPC ..... 347/65, 84, 85
See application file for complete search history.

(56) References Cited

U.S. PATENT DOCUMENTS

| | | | | |
|---|---|---|---|---|
| 5,355,158 | A | 10/1994 | Inada et al. | 347/22 |
| 5,479,196 | A | 12/1995 | Inada | 347/92 |
| 6,164,769 | A | 12/2000 | Inada et al. | 347/86 |
| 6,293,663 | B1 | 9/2001 | Koshikawa et al. | 347/86 |
| 6,325,500 | B1 | 12/2001 | Kitabatake et al. | 347/86 |
| 6,382,783 | B1 | 5/2002 | Hayashi et al. | 347/85 |
| 6,382,785 | B2 | 5/2002 | Inada et al. | 347/86 |
| 6,390,601 | B1 | 5/2002 | Morita et al. | 347/49 |
| 6,402,298 | B1 | 6/2002 | Nanjo et al. | 347/49 |
| 6,443,567 | B1 | 9/2002 | Hayashi et al. | 347/85 |
| 6,450,631 | B1 | 9/2002 | Hayashi et al. | 347/86 |
| 6,454,400 | B1 | 9/2002 | Morita et al. | 347/86 |
| 6,471,343 | B1 | 10/2002 | Shimizu et al. | 347/85 |
| 6,505,923 | B1 | 1/2003 | Yamamoto et al. | 347/85 |
| 6,511,167 | B1 | 1/2003 | Kitabatake et al. | 347/86 |
| 6,530,654 | B2 | 3/2003 | Kitabatake et al. | 347/86 |
| 6,540,342 | B2 | 4/2003 | Koshikawa et al. | 347/86 |

(Continued)

FOREIGN PATENT DOCUMENTS

| | | |
|---|---|---|
| JP | 2009-073120 | 4/2009 |
| JP | 2010-194861 | 9/2010 |

(Continued)

*Primary Examiner* — Huan Tran
*Assistant Examiner* — Alexander D Shenderov
(74) *Attorney, Agent, or Firm* — Fitzpatrick, Cella, Harper & Scinto

(57) ABSTRACT

There is provided a liquid ejecting device including a damper device which can sufficiently absorb dynamic pressure of a liquid while miniaturization of a device body is achieved and which can be easily manufactured. For that purpose, a part of an ink storage unit in the damper device is formed by a flexible member having a convex shape.

10 Claims, 15 Drawing Sheets

(56) References Cited

U.S. PATENT DOCUMENTS

| | | | | |
|---|---|---|---|---|
| 6,543,886 | B1 | 4/2003 | Hattori et al. | 347/85 |
| 6,550,898 | B2 | 4/2003 | Hayashi et al. | 347/85 |
| 6,598,963 | B1 | 7/2003 | Yamamoto et al. | 347/85 |
| 6,631,982 | B2 | 10/2003 | Sasaki et al. | 347/85 |
| 6,652,949 | B2 | 11/2003 | Iwanaga et al. | 428/65.9 |
| 6,705,715 | B2 | 3/2004 | Morita et al. | 347/87 |
| 6,709,092 | B2 | 3/2004 | Hayashi et al. | 347/86 |
| 6,719,394 | B2 | 4/2004 | Kubota et al. | 347/19 |
| 6,719,415 | B1 | 4/2004 | Hattori et al. | 347/86 |
| 6,796,645 | B2 | 9/2004 | Hayashi et al. | 347/86 |
| 6,805,434 | B2 | 10/2004 | Hayashi et al. | 347/85 |
| 6,805,437 | B2 | 10/2004 | Yamanaka et al. | 347/92 |
| 6,827,431 | B2 | 12/2004 | Kitabatake et al. | 347/86 |
| 6,851,795 | B2 | 2/2005 | Watanabe et al. | 347/50 |
| 6,851,798 | B2 | 2/2005 | Koshikawa et al. | 347/85 |
| 6,863,762 | B2 | 3/2005 | Sanada et al. | 156/180 |
| 6,869,158 | B2 | 3/2005 | Kojima et al. | 347/19 |
| 6,921,161 | B2 | 7/2005 | Morita et al. | 347/86 |
| 6,945,643 | B2 | 9/2005 | Tajima et al. | 347/87 |
| 6,994,431 | B2 | 2/2006 | Kitabatake et al. | 347/86 |
| 6,997,548 | B2 | 2/2006 | Matsuo et al. | 347/86 |
| 7,029,107 | B2 | 4/2006 | Kitabatake et al. | 347/86 |
| 7,044,588 | B2 | 5/2006 | Tajima et al. | 347/85 |
| 7,111,931 | B2 | 9/2006 | Amma et al. | 347/86 |
| 7,165,829 | B2 | 1/2007 | Hayashi et al. | 347/49 |
| 7,350,910 | B2 | 4/2008 | Amma et al. | 347/86 |
| 7,384,116 | B2 | 6/2008 | Kotaki et al. | 347/19 |
| 7,445,322 | B2 | 11/2008 | Kitabatake et al. | 347/86 |
| 7,581,807 | B2 | 9/2009 | Hatasa et al. | 347/19 |
| 7,735,984 | B2 | 6/2010 | Iijima et al. | 347/86 |
| 7,926,927 | B2 | 4/2011 | Kotaki et al. | 347/86 |
| 8,011,768 | B2 | 9/2011 | Hayashi et al. | 347/86 |
| 8,038,272 | B2 | 10/2011 | Okazaki | 347/85 |
| 8,109,617 | B2 | 2/2012 | Kotaki et al. | 347/86 |
| 8,136,930 | B2 | 3/2012 | Anma et al. | 347/86 |
| 8,356,891 | B2 | 1/2013 | Takata | 347/94 |
| 8,439,491 | B2 | 5/2013 | Hayashi et al. | 347/86 |
| 8,485,642 | B2 | 7/2013 | Hayashi et al. | 347/49 |
| 9,321,274 | B2 | 4/2016 | Takagi et al. | B41J 2/17553 |
| 2003/0038867 | A1 | 2/2003 | Yamamoto et al. | 347/86 |
| 2008/0225090 | A1* | 9/2008 | Kobayashi | B41J 2/175 347/85 |
| 2010/0122460 | A1* | 5/2010 | Takata | B41J 2/175 29/890.1 |
| 2010/0214332 | A1* | 8/2010 | Iwase | B41J 2/175 347/7 |
| 2016/0200113 | A1 | 7/2016 | Nanjo et al. | B41J 2/175 |
| 2016/0200114 | A1 | 7/2016 | Nanjo et al. | B41J 2/17553 |

FOREIGN PATENT DOCUMENTS

| | | |
|---|---|---|
| JP | 2010-214845 | 9/2010 |
| JP | 2010-240894 | 10/2010 |

* cited by examiner

LIQUID EJECTING DEVICE

BACKGROUND OF THE INVENTION

Field of the Invention

The present invention relates to a liquid ejecting device that ejects a liquid supplied from an ink tank.

Description of the Related Art

A liquid ejecting device that supplies a liquid to a liquid ejecting head on a carriage through a tube from an ink tank is known. In this type of liquid ejecting device, a dynamic pressure is generated in the liquid in the tube by an inertia force or the like caused by movement of the carriage, and the dynamic pressure may affect ejection in some cases.

Japanese Patent Laid-Open No. 2009-73120 describes that, in order to absorb the dynamic pressure of the liquid along with the movement of the carriage, a damper device in which a flexible film is welded to a channel member formed flatly is provided.

In response to a recent request for size reduction of the liquid ejecting device, the size reduction of the liquid ejecting head and the damper device is in demand. However, in a case where the size of the damper device is reduced, and an area of the flexible film is narrowed, the dynamic pressure of the liquid cannot be sufficiently absorbed.

The damper device described in Japanese Patent Laid-Open No. 2009-73120 can sufficiently absorb the dynamic pressure of the liquid but a relatively wide space is needed for installation and cannot meet the request for size reduction. Moreover, in a case where the flexible film having a wide area is to be stored in a small-sized component, its structure becomes complicated, and manufacturing becomes difficult.

SUMMARY OF THE INVENTION

Therefore, the present invention provides a liquid ejecting device including a damper device which can sufficiently absorb the dynamic pressure of the liquid while size of a device body is reduced and which can be easily manufactured.

Accordingly, a liquid ejecting device comprising:

a liquid ejecting head which ejects liquid;

a damper unit having a liquid storage unit for storing the liquid to be supplied to the liquid ejecting head;

a carriage configured to move with the liquid ejecting head and the damper unit mounted thereon;

a liquid containing portion which contains the liquid to be supplied to the liquid storage unit; and a tube which connects the liquid storage unit and the liquid containing portion;

wherein, the liquid storage unit has a part formed of a convex shaped flexible member, and the damper unit has a holding portion for holding the convex shaped flexible member.

Further features of the present invention will become apparent from the following description of exemplary embodiments (with reference to the attached drawings).

DESCRIPTION OF THE EMBODIMENTS

First Embodiment

Figure 1:
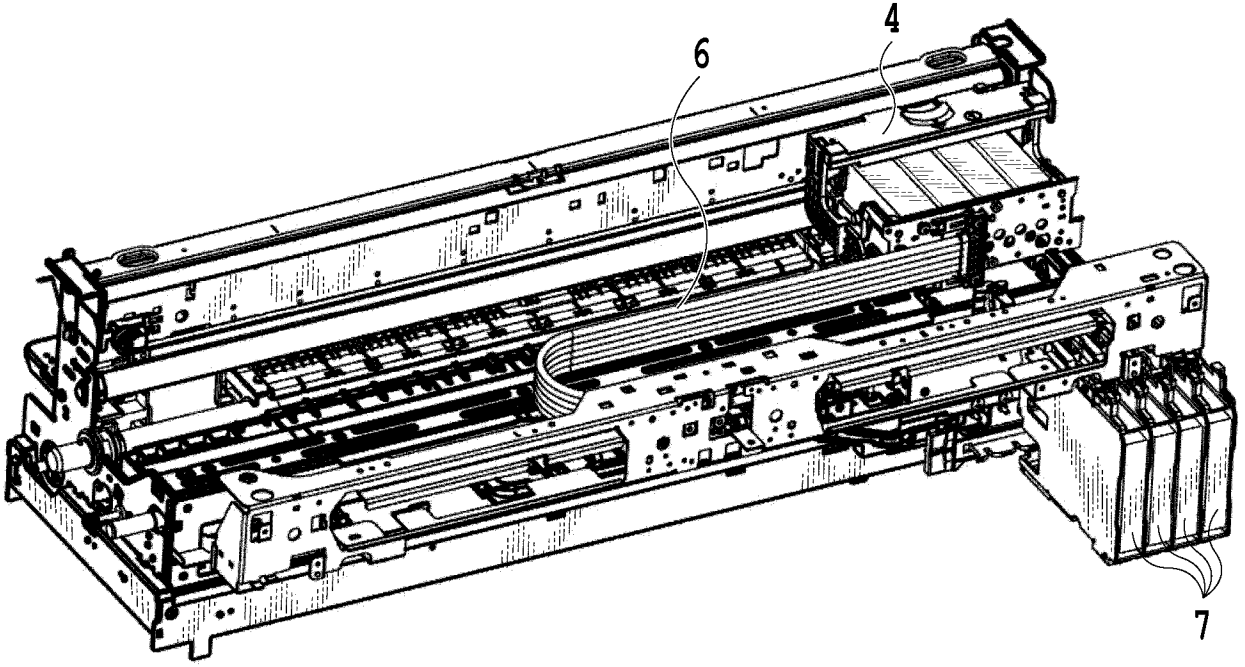
FIG. 1 is a perspective view illustrating a liquid ejecting device.

A first embodiment of the present invention will be described below by referring to the drawings.

FIG. 1 is a perspective view illustrating a liquid ejecting device according to the present embodiment. In the liquid ejecting device, a pair of guide rails extending in a main scanning direction and provided in parallel are arranged. A carriage 4 on which a liquid ejecting head that ejects a liquid (hereinafter, also referred to as ink) is mounted is arranged, on the guide rails, capable of scanning on a sheet in the main scanning direction. An ink tank 7 that supplies the ink to the liquid ejecting head is installed for each color in the liquid ejecting device, and the ink in the ink tank 7 is supplied to the liquid ejecting head on the carriage 4 via a tube 6.

Figure 2A:
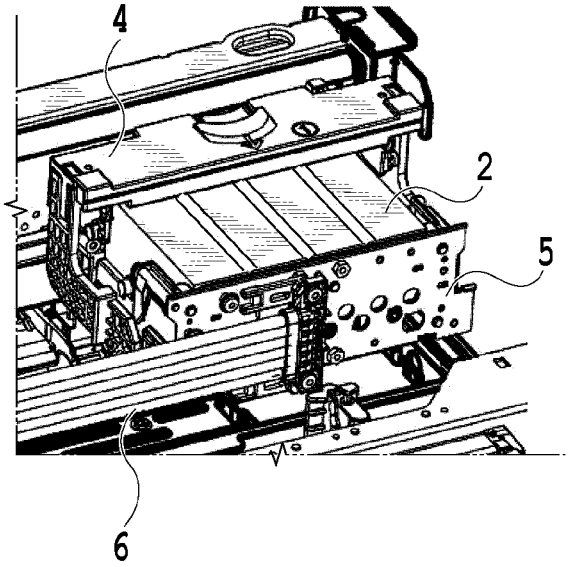
FIG. 2A is a perspective view illustrating a liquid ejecting head mounted on a carriage, and its periphery.
Figure 2B:
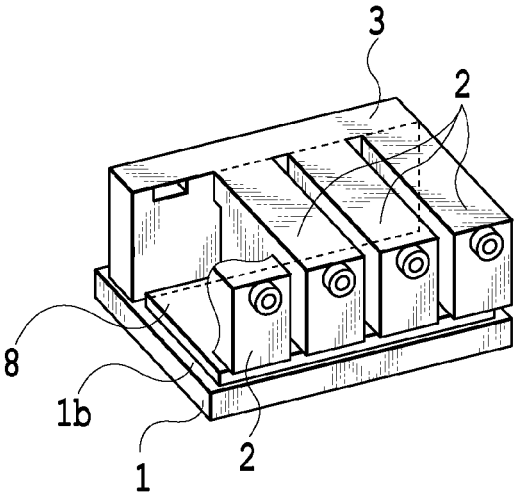
FIG. 2B is a perspective view illustrating the liquid ejecting head mounted on the carriage, and its periphery.
Figure 2C:
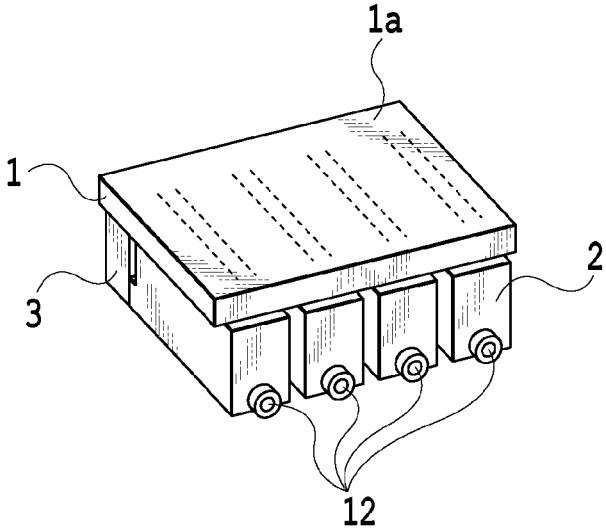
FIG. 2C is a perspective view illustrating the liquid ejecting head mounted on the carriage, and its periphery.

FIGS. 2A to 2C are perspective views illustrating the liquid ejecting head mounted on the carriage 4 of the liquid ejecting device in FIG. 1 and its periphery. The carriage 4 is provided with the liquid ejecting head 1, a damper device 2, and an air-bubble trap device 3. The liquid ejecting head 1 is provided in response to the ink of four colors, that is, black Bk, cyan C, magenta M, and yellow Y. Furthermore, the four damper devices 2 corresponding to the four-color ink are juxtaposed in the main scanning direction and provided on the carriage 4.

The air-bubble trap device 3 via a seal rubber and an electrical substrate 8 used for ejection driving of ink droplets are provided on a surface (hereinafter referred to as a back surface 1*b*) opposite to an ejecting port surface 1*a* in which an ejecting port that ejects the ink of the liquid ejecting head 1 is provided. An inside of the air-bubble trap device 3 is partitioned into four vertically long chambers and vertical ink channels are formed, and are connected to the respective damper devices 2 of the ink of four colors. An inlet 12 capable of supplying the ink into each of the damper devices is connected to a joint unit 5, and a supply tube 6 formed of a flexible material is connected via the joint unit 6.

Each of the ink tanks 7 of four colors is placed at a position lower than the ejecting port surface 1*a* of the liquid ejecting head 1 outside the carriage 4, maintains the ink in a path from the ink tank 7 to the ejecting port at a negative pressure by this height difference (head difference), and maintains an ink interface at the ejecting port in an optimal state. The ink is supplied to the liquid ejecting head 1 through the supply tube 6, the joint unit 5, the damper device 2, and the air-bubble trap device 3 in this order. An air-bubble discharge port (not shown) is provided above the air-bubble trap device 3. The air bubbles trapped by the air-bubble trap device 3 are discharged by a timely suction operation.

Figure 3A:
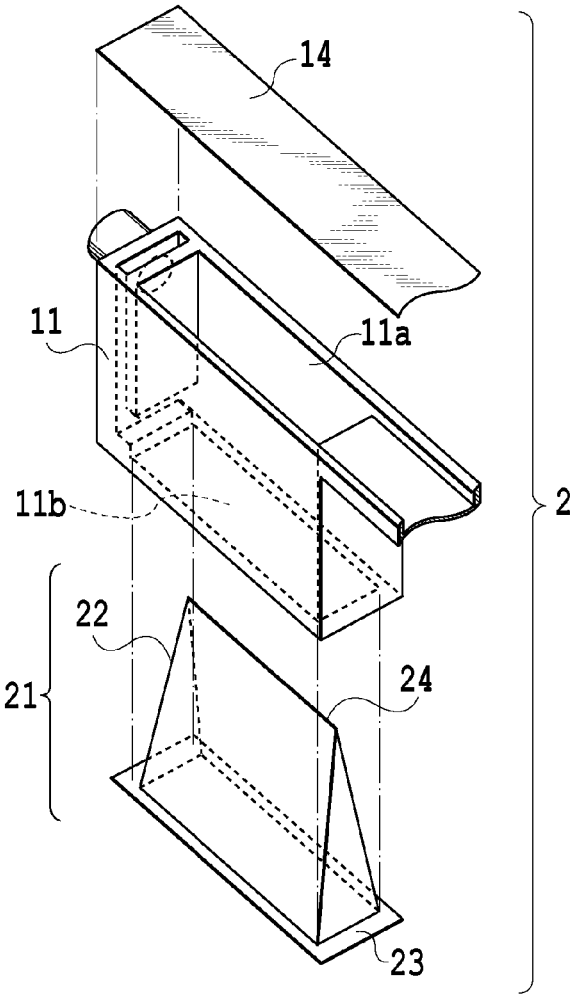
FIG. 3A is a perspective view illustrating a damper device.
Figure 3B:
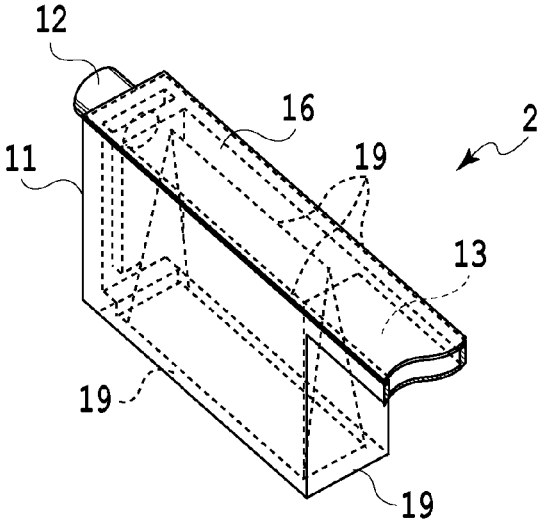
FIG. 3B is a perspective view illustrating the damper device.
Figure 4A:
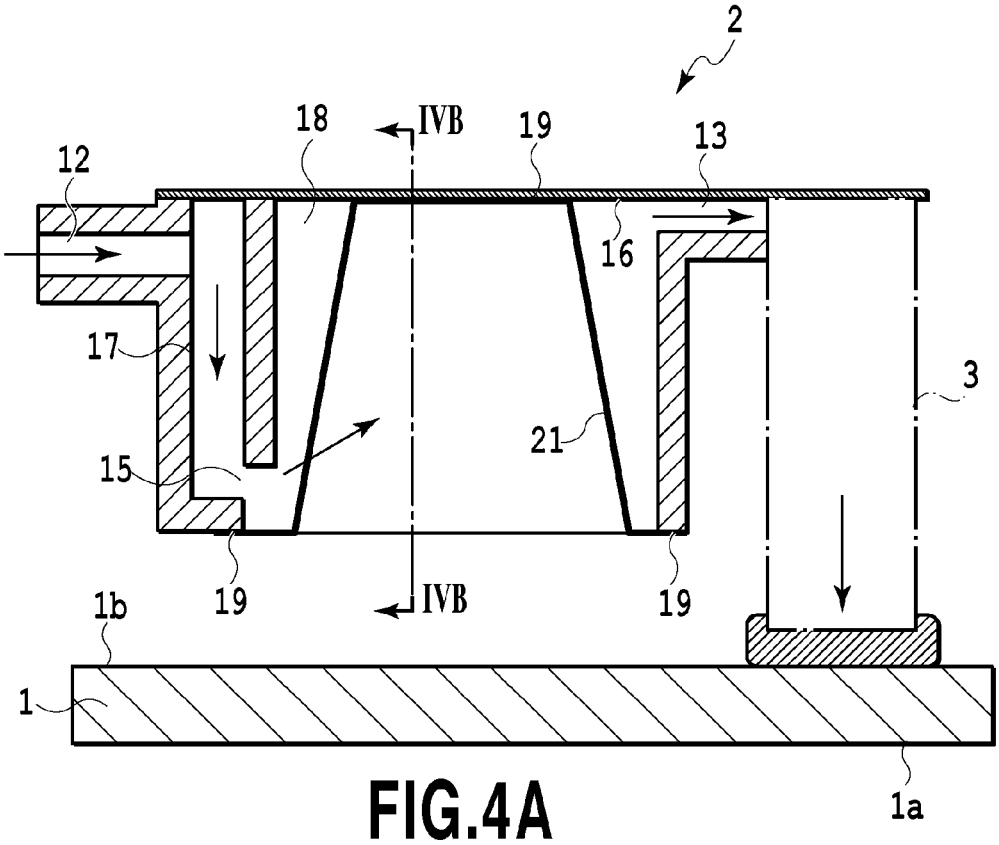
FIG. 4A is a cross-sectional view of the damper device.
Figure 4B:
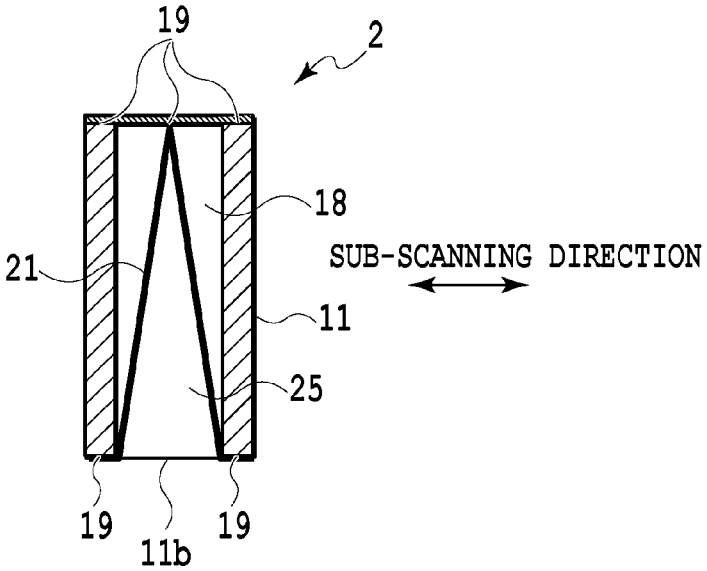
FIG. 4B is a cross-sectional view of the damper device.

FIGS. 3A and 3B are perspective views illustrating the damper device 2 in the present embodiment, FIG. 4A is a cross-sectional view of the damper device 2, and FIG. 4B is a cross-sectional view on IVB-IVB of FIG. 4A. The damper device 2 includes an inlet 12 and an outlet 13, and the ink flowing in from the inlet 12 flows out from the outlet 13 through the damper device 2. The ink flowing out from the outlet 13 is supplied to the liquid ejecting head 1.

The damper device 2 includes a flexible member 21, the inlet 12, the outlet 13, and a box-shaped ink container 11 in which a lower surface 11*b* is opened for inserting therethrough the flexible member 21. A flexible film 14 forms a part of an outer shape of the damper device 2, and an upper surface 11*a* facing the opened lower surface 11*b* of the ink container 11 is sealed by the flexible film 14. An end portion of a vertical passage 17, the outlet 13 communicating with the air-bubble trap device 3, and a ceiling portion 16 of the ink container 11 are formed by sealing with this flexible film 14.

Note that the air-bubble trap device 3, the ceiling portions of the four damper devices, and an upper surface of the ink outlet 13 may be formed all at once by integrally molding the air-bubble trap device 3 and the four ink containers 11 and by joining one flexible film.

The flexible member 21 is a laminated body obtained by laminating different types of materials as described below via an adhesive layer, and a surface of polypropylene (PP) of the flexible member 21 is joined to the ink container 11.

polyethylene terephthalate (PET): 12 μm
nylon (NY): 16 μm
polypropylene (PP): 26 μm Note that a welded layer made of silicon (Si) is formed on a surface of the polyethylene terephthalate (PET) layer on the nylon (NY) side. Furthermore, the flexible member 21 is also made of a laminated body of polypropylene (PP), nylon (NY), and polyethylene terephthalate (PET) similarly to the flexible film 14 forming the ceiling portion 16 of the ink container 11.

The inlet 12 is provided on an inlet end portion of the vertical passage 17 extending in a vertical direction to the vicinity of the lower surface of the ink container 11. Moreover, the outlet 13 is provided at a position facing the inlet 12 in the vicinity of the ceiling portion of the ink container 11.

The flexible member 21 has a substantially trapezoidal shape as in FIG. 4A when being viewed from the main scanning direction and has a projecting portion 22 having a substantially triangular shape as in FIG. 4B when being viewed from a sub-scanning direction. The flexible member 21 is inserted into the ink container 11 through the open lower surface 11*b* of the ink container 11 so that a top portion 24 is in contact with the ceiling portion 16.

The damper device 2 is provided with a heat welding unit 19, and a sleeve portion 23 of the flexible member 21 is joined and sealed with the periphery of the lower surface 11*b* of the ink container 11, by heat welding. Moreover, at least a part of the top portion 24 of the flexible member 21 is joined to the flexible film 14 of the ceiling portion 16, by heat welding. Appropriate slacking may be given to a surface of the joined flexible film 14. As described above, the damper device 2 forms an ink storage unit (liquid storage unit) 18 between an inner surface of the ink container 11 and an outer surface of the flexible member 21 by welding the flexible film 14. Moreover, a hollow portion 25 open to the atmospheric air inside the ink container 11 can obtain an absorbing effect of a fluctuating pressure of the ink.

An arrow in FIG. 4A indicates a flow of the ink in the damper device 2. The ink enters the inside of the damper device through the inlet 12 and is supplied from a lower part of the damper device 2 to the ink storage unit 18 through the vertical passage 17 communicating with the inlet 12. The ink supplied to the ink storage unit 18 is stored in contact with the outer surface of the projecting portion 22 from which the flexible member 21 projects. The ink supplied to the ink storage unit 18 is discharged from the damper device 2 through the outlet 13 at an upper part of the damper device 2. In a case where air bubbles are generated (flow) in the ink storage unit 18, the air bubbles floating above the ink storage unit 18 is discharged from the outlet 13 at the upper part.

Fluctuation of an oscillating pressure of the ink propagating from the supply tube 6 in a case where a dynamic pressure is generated in the ink in the tube, due to an inertia force caused by movement of the carriage 4 during ink ejection, is absorbed and damped by deflection of the flexible member 21 of the damper device 2, and the propagation of the dynamic pressure to a downstream of the damper device 2 is reduced.

A three-dimensional shape of a convex structure (projecting portion 22) of the flexible member 21 and the sleeve portion 23 are formed by hot forming of a film-shaped laminated body. At this time, the surface on the projecting side is constituted the surface on the projecting side is constituted so as to have polypropylene (PP). The flexible films 14 forming the sleeve portion 23, tip ends of the ink container 11 and the projecting portion 22, and the ceiling portion 16 are brought into contact so that the respective surfaces of polypropylene (PP) contact with each other, and are joined by heat welding. The heat welding of the ink container 11 and the flexible member 21 as well as the flexible film 14 is all performed by planar welding, whereby highly reliable sealing performance can be obtained.

The damper device 2 of the present embodiment absorbs the pressure fluctuation in contact with the ink on the outer surface of the projecting portion 22 of the flexible member 21 three-dimensionally molded. As described above, a pressure-absorbing surface can be formed with a relatively large area in a small space by forming the flexible member 21 in a convex shape in the ink container. As a result, while the sufficient area capable of absorbing the dynamic pressure of the ink is ensured, the reduction in a projection area of the flexible member 21 viewed from a front (upper part in FIG. 4A) realizes miniaturization of the damper device 2, and a large number of the high-performance damper devices 2 can be mounted on the carriage with a limited space. Furthermore, since at least a part of the projecting portion 22 is fixed to the flexible film 14 of the ceiling portion 16, the flexible member 21 can maintain the convex shape without large deformation even in a case where a strong negative pressure acts on the ink due to a suction restoring operation and the like. Accordingly, there is no concern that the performance of absorbing the pressure fluctuation of the ink deteriorates.

Furthermore, an action of agitating the ink in the ink container 11 can be obtained by deformation of the flexible member 21. Therefore, the ink is suitable for a printer using, for example, pigment ink or the like, in which the ink component can be easily biased in a case where the ink is left for a long time.

Moreover, since the projecting portion 22 of the flexible member 21 is stored in the ink container 11, there is a small risk that the flexible member 21 is accidentally broken during assembling of an inkjet recording apparatus.

The liquid ejecting device may be filled with storage ink exclusively for physical distribution in a supply system during the physical distribution. In this case, at start of use of the liquid ejecting device, the storage ink needs to be replaced by ink for recording. Since, in the damper device 2 in the present embodiment, the vertical passage 17 communicating with the inlet is located at the lower part, while the outlet 13 is located at the upper part and at the diagonal position of the vertical passage 17, ink replacement in the ink storage unit 18 is easy.

Note that the positions where the inlet 12 and the outlet 13 of the damper device 2 are provided are not limited to the positions described in the present embodiment.

Furthermore, a material of the flexible member may be selected in view of ink resistance, gas barrier performance, and damping performance as long as the material is a thermally extendable material. In addition, a material of the ink container 11 may be selected in view of ink resistance and gas barrier performance.

Moreover, the liquid ejecting device capable of using the ink of four colors has been described as an example in the present embodiment, but the number of ink colors is not limited to four.

In addition, the shape, material, and surface area of the flexible member inside the damper device in a certain color may be different from those of the others, depending on required damping performance.

Furthermore, the damper device may have the projecting portion 22 of the flexible member 21 in the ink container, downward in the vertical direction. All the tip ends of the projecting portion 22 of the flexible member 21 may be joined to the inner surface of the ink container 11. Alternatively, the portion other than the tip end of the projecting portion may be joined to the inner surface of the ink container.

Moreover, the damper device 2 may be arranged in an attitude in which the device is vertically inverted and the projecting portion of the flexible member 21 is directed downward, or the damper device 2 may be arranged in an attitude in which the projecting portion 22 is directed to a sub-scanning direction by bringing the damper device into a state of falling sideways.

In addition, although heat welding is used for joining or the like of the flexible member 21, there may be used welding by vibration, joining using an adhesive, or the like. Furthermore, the damper devices corresponding to the ink of four colors may be integrated.

Figure 10A:
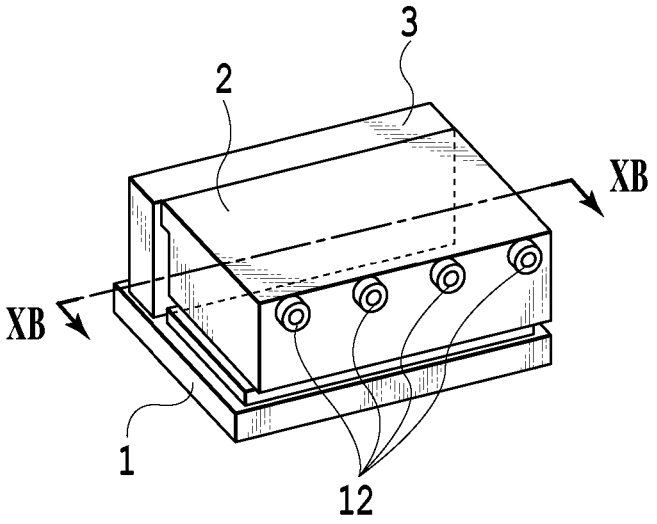
FIG. 10A is a view illustrating an integrated-type damper device partitioned into four ink storage units.
Figure 10B:
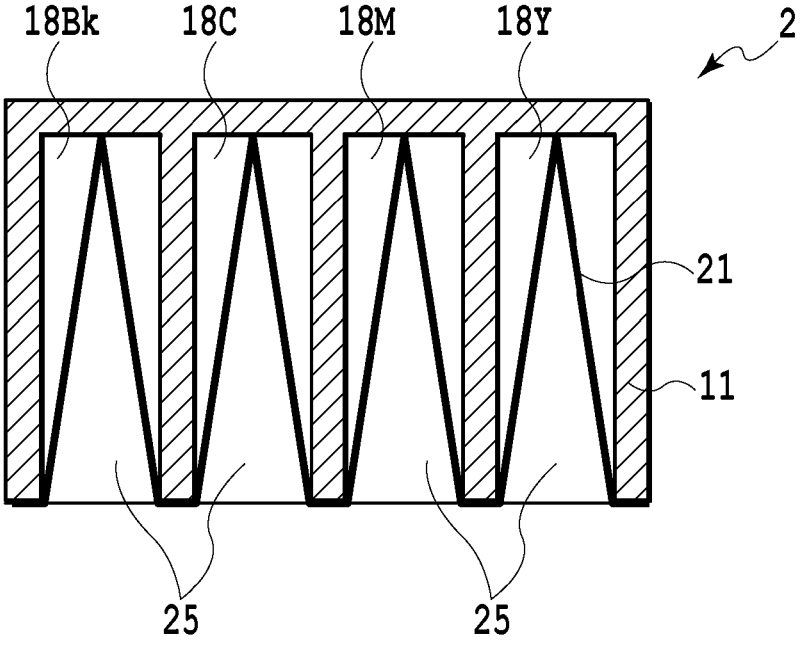
FIG. 10B is a view illustrating the integrated-type damper device partitioned into the four ink storage units.

FIGS. 10A and 10B are examples of the integrated-type damper device in which one ink container 11 is partitioned into four ink storage units. FIG. 10B is an XB-XB cross section of FIG. 10A, and ink of four colors is stored in each of ink storage units 18Bk, 18C, 18M and 18Y. As a result, miniaturization of the damper device is made possible.

As described above, a part of the ink storage unit in the damper device is formed of the flexible member including a convex shape. Accordingly, the dynamic pressure of the liquid can be sufficiently absorbed while the miniaturization of the device body is achieved, and thus the liquid ejecting device including the damper device easily manufactured was able to be realized.

Second Embodiment

Hereinafter, a second embodiment of the present invention will be described by referring to the drawings. Note that, since a basic configuration of the present embodiment is similar to that of the first embodiment, only a characteristic configuration will be described below.

Figure 5A:
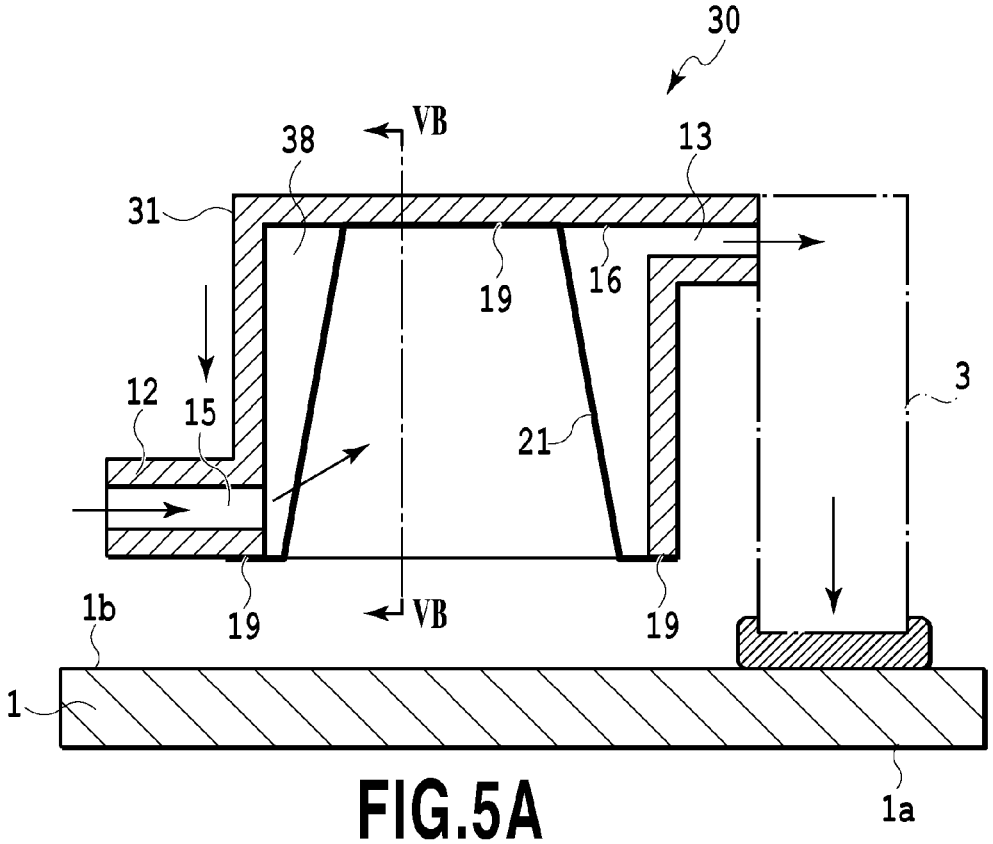
FIG. 5A is a cross-sectional view of the damper device.
Figure 5B:
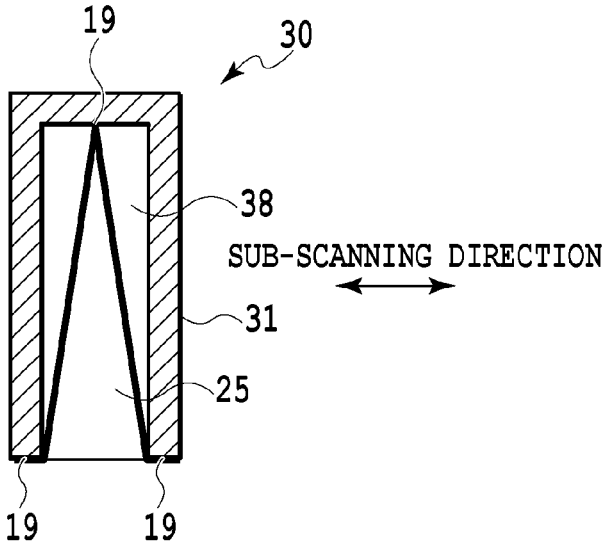
FIG. 5B is a cross-sectional view of the damper device.

FIG. 5A is a cross-sectional view illustrating a damper device 30 in the present embodiment, and FIG. 5B is a cross-sectional view on VB-VB of FIG. 5A. In the damper device 2 of the first embodiment, the upper surface facing the open lower surface of the box-shaped ink container 11 is sealed by the flexible film 14, but in an ink container 31 of the present embodiment, the upper surface is also integrally molded similarly to the other wall surfaces. Furthermore, the inlet 15 through which the ink flows into an ink storage unit 38 is provided in the vicinity of the lower surface of an ink container 31, and the outlet 13 is provided at a diagonal position of the ink container 31 with respect to the ink inlet near the ceiling portion.

The sleeve portion 23 of the flexible member 21 is joined to the periphery of the lower surface of the ink container 31, by heat welding. Moreover, apart of a tip end of an ejecting portion of the flexible member 21 is joined to the ceiling portion 16 by heat welding. Accordingly, the damper device 30 forms the ink storage unit 38 between an inner surface of the ink container and an outer surface of the flexible member 21.

In the configuration of the present embodiment, the ink storage unit 38 is covered by a wall surface having an appropriate thickness of the ink container 31 excluding a part of the ink storage unit 38 formed by the flexible member 21, and thus gas barrier performance against ink evaporation in the ink storage unit 38 is excellent and ink evaporation can be suppressed.

Third Embodiment

Hereinafter, a third embodiment of the present invention will be described by referring to the drawings. Note that, since a basic configuration of the present embodiment is similar to that of the first embodiment, only a characteristic configuration will be described below.

Figure 6A:
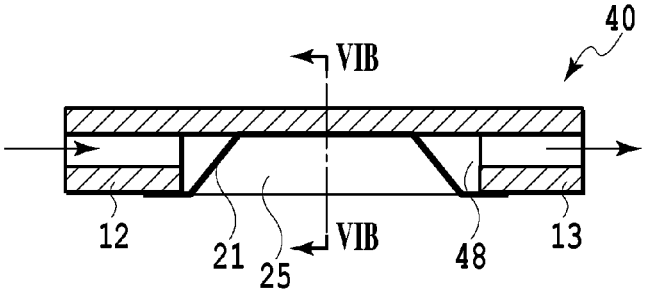
FIG. 6A is a cross-sectional view of the damper device.
Figure 6B:
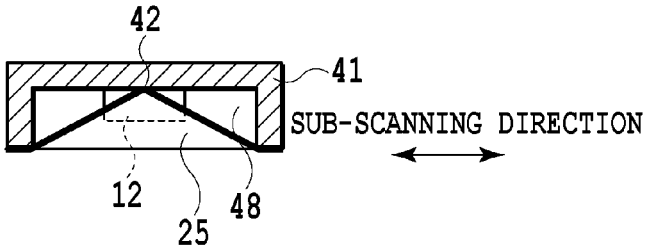
FIG. 6B is a cross-sectional view of the damper device.

FIG. 6A is a cross-sectional view illustrating a damper device 40 in the present embodiment, and FIG. 6B is a cross-sectional view on VIB-VIB of FIG. 6A. In an ink container 41 of the damper device 40 in the present embodiment, an upper surface of the box-shaped ink container 41 is integrally molded in the same way as the other wall surfaces similarly to the second embodiment.

The damper device 40 of the present embodiment has a shape having a width larger than a height, as illustrated in FIG. 6B. The height of the damper device 40 can be reduced by lowering a bending rate at a top portion 42 of the flexible member 21. Therefore, a printer itself can be miniaturized, and installation thereof in a thin-type inkjet printer for mobile application is easy.

Note that a plurality of the damper devices in FIG. 6A may be stacked on the carriage in the vertical direction. Alternatively, they may be juxtaposed in a horizontal direction.

Figure 6C:
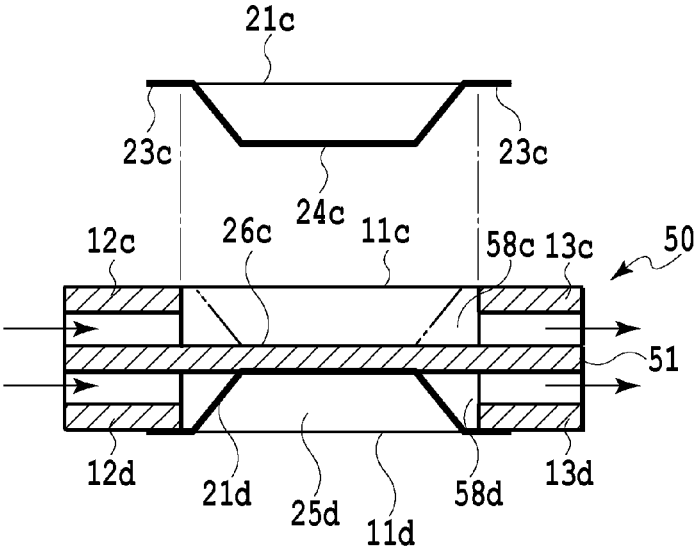
FIG. 6C is a cross-sectional view of the damper device.

Moreover, as in FIG. 6C, the two damper devices may be integrated and miniaturized by combining them so that the projecting portions of the flexible members 21 face each other and project. A molded flexible member 21*c* is inserted through an opened upper surface 11*c* of an ink container 51, and a sleeve portion 23*c* and a top portion 24*c* of the flexible member 21*c* are joined to the ink container 51. Note that the top portion 24*c* is joined to a surface 26*c* on an inner side of the ink container 51. Similarly, the molded flexible member 21*d* is inserted through an opened lower surface 11*d* of the ink container 51 and joined to the ink container 51 to thereby form an ink storage unit 58*d*.

In the damper device 50, the ink flows into the each of the ink storage units through two inlets 12*c* and 12*d* and flows out from outlets 13*c* and 13*d* through the ink storage units 58*c* and 58*d*. The oscillating pressure fluctuation propagating from the supply tube during ejection is individually absorbed/damped by the three-dimensional flexible members 21*c* and 21*d* of the damper device 50, respectively, and the propagation to the downstream of the damper device 50 is reduced.

Fourth Embodiment

Hereinafter, a fourth embodiment of the present invention will be described by referring to the drawings. Note that, since a basic configuration of the present embodiment is similar to that of the first embodiment, only a characteristic configuration will be described below.

Figure 7A:
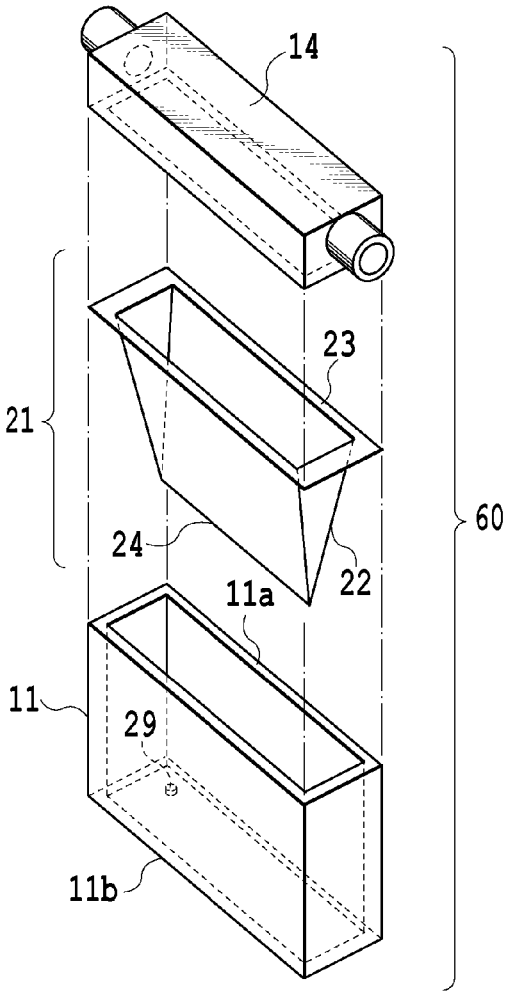
FIG. 7A is a perspective view illustrating the damper device.
Figure 7B:
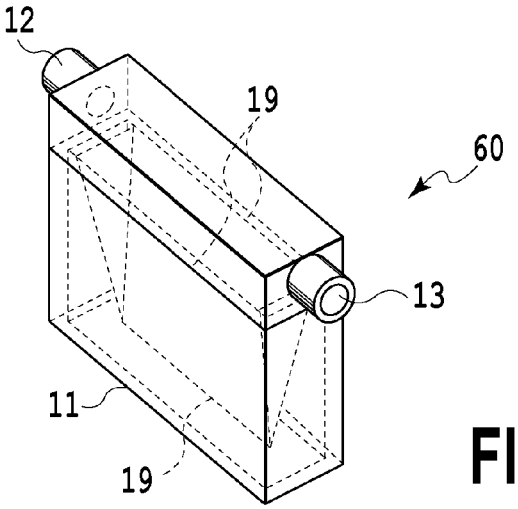
FIG. 7B is a perspective view illustrating the damper device.
Figure 8A:
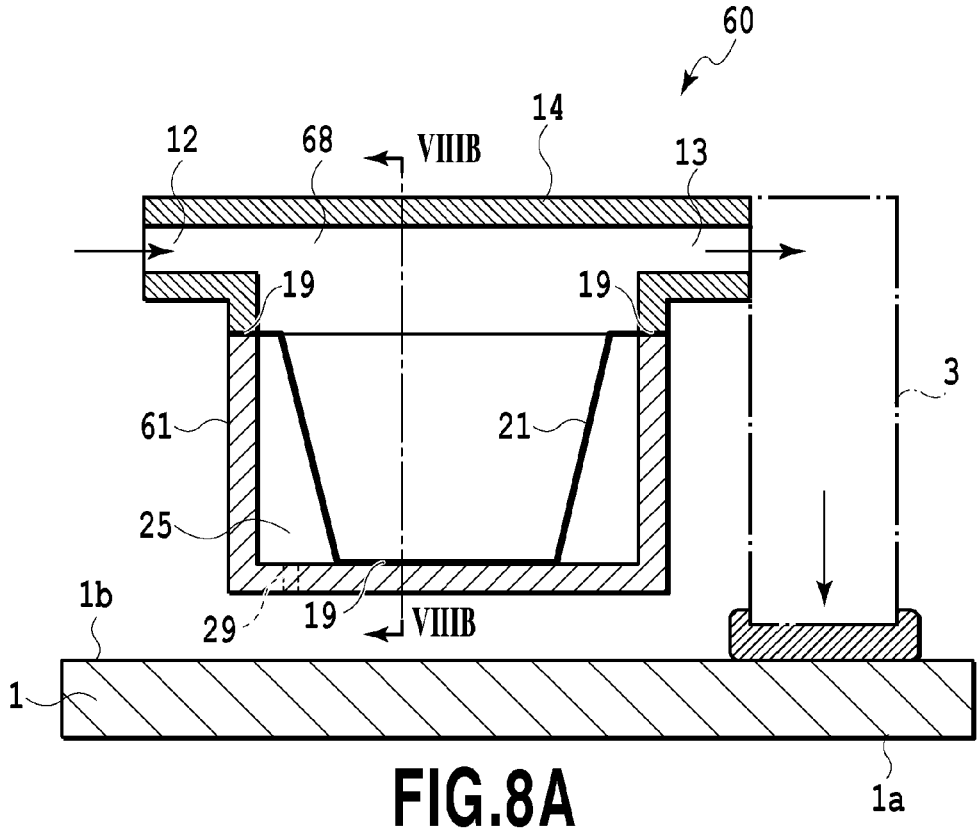
FIG. 8A is a cross-sectional view of the damper device.
Figure 8B:
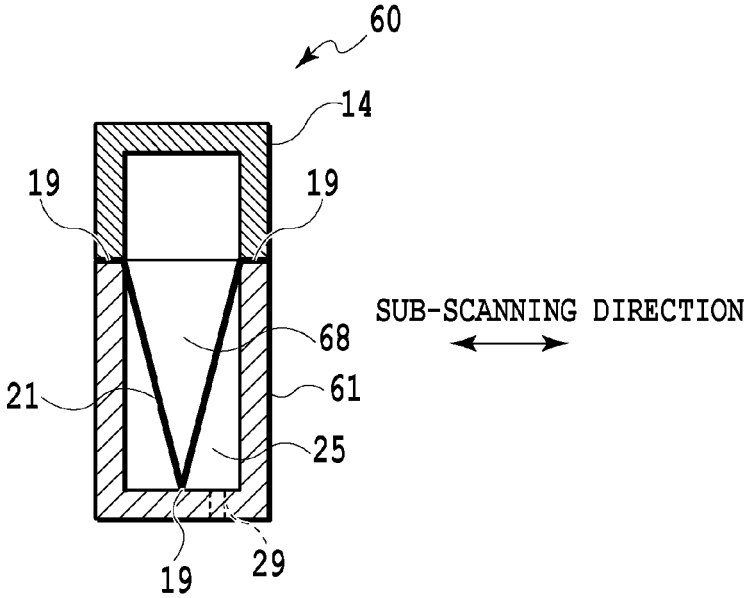
FIG. 8B is a cross-sectional view of the damper device.

FIGS. 7A and 7B are perspective views illustrating a damper device 60 in the present embodiment, FIG. 8A is a cross-sectional view of the damper device 60, and FIG. 8B is a cross-sectional view on VIIIB-VIIIB of FIG. 8A.

The damper device 60 of the present embodiment includes the flexible member 21, a lid 14 having the inlet 12 and the outlet 13, and a box-shaped ink container 61 in which the upper surface 11*a* is opened for inserting therethrough the flexible member 21. The ink container 61 and the lid 14 are formed of polypropylene (PP).

The sleeve portion 23 of the flexible member 21 inserted through the upper surface 11*a* is joined to the periphery of the upper surface 11*a* of the ink container 61 by heat welding and is sealed. Furthermore, at least a part of the top portion 24 of the flexible member 21 is joined to the lower surface 11*b* of the ink container 61, by heat welding. The lid 14 is joined to the upper surface 11*a* of the ink container 61, by heat welding, after the flexible member 21 is inserted and joined to the ink container 61.

In the damper device 60 of the present embodiment, an ink storage unit 68 is formed inside the flexible member 21 inserted. The ink having flowed into the damper device 60 through the inlet 12 is supplied to the ink storage unit 68, and is stored in contact with an inner surface of the projecting portion 22 from which the flexible member 21 projects. The ink stored in the ink storage unit 68 is supplied to a device on the downstream side from the outlet 13. Furthermore, a space open to the atmospheric air by an atmospheric communication port 29 is provided on an outer side of the projecting portion 22 from which the flexible member 21 projects.

In the aforementioned first to third embodiments, in the flexible member 21 forming a part of the ink storage unit, a ratio occupied by the flexible member 21 in the ink storage unit is small. However, in the present embodiment, the ratio occupied by the flexible member 21 in the ink storage unit 68 is larger than each of those in the first to third embodiments. Therefore, it is easier to deflect the flexible member 21 in accordance with fluctuation of the ink pressure in the present embodiment than in the first to third embodiments. Therefore, the fluctuating pressure can be flexibly absorbed in response to the fluctuating pressure of the ink during ink ejection, and propagation of the fluctuating pressure to the downstream of the damper device is reduced.

Furthermore, the flexible member 21 is surrounded by the ink container 61 made of polypropylene and is covered by a wall surface of a resin molded body including an appropriate thickness, and thus a space between the flexible member 21 and the ink container 61 can be kept at a ink saturated steam pressure. Accordingly, the gas barrier performance against ink evaporation in the ink storage unit 68 can be enhanced, and ink evaporation can be suppressed. The space between the flexible member 21 and the ink container 61 communicates with the atmospheric air through the atmospheric communication port 29 and is configured such that a motion of the flexible member 21 is not regulated excessively, but can be configured such that the ink saturated steam pressure can be kept by appropriately selecting an opening size, a length and the like of the atmospheric communication port 29.

Fifth Embodiment

Hereinafter, a fifth embodiment of the present invention will be described by referring to the drawings. Note that, since a basic configuration of the present embodiment is similar to that of the first embodiment, only a characteristic configuration will be described below.

Figure 9A:
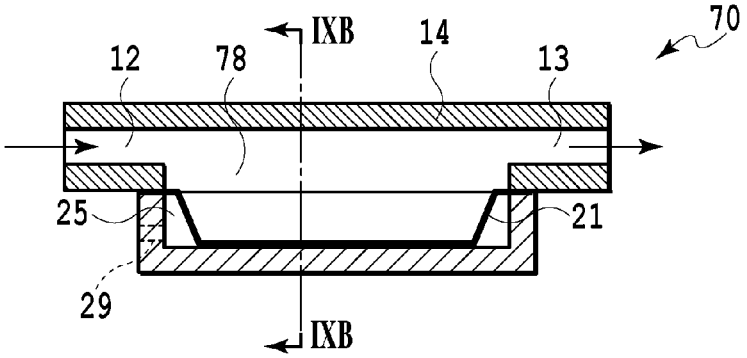
FIG. 9A is a cross-sectional view of the damper device.
Figure 9B:
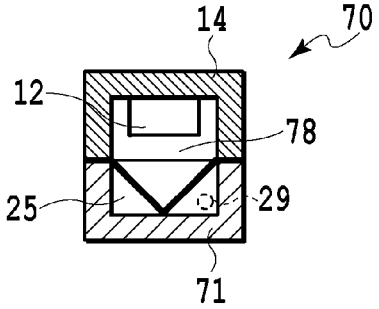
FIG. 9B is a cross-sectional view of the damper device.

FIG. 9A is a view illustrating a cross section of a damper device 70 of the present embodiment, and FIG. 9B is an IXB-IXB cross section of FIG. 9A. An ink container 71 of the damper device 70 of the present embodiment is opened at its lower part similarly in the fourth embodiment, and the flexible member 21 is inserted through the lower part opened.

The damper device 70 of the present embodiment has an ink storage unit 78 formed inside the flexible member 21 inserted. The ink having flowed into the damper device 70 through the inlet 12 is supplied to the ink storage unit 78 and is stored in contact with an inner surface of the projecting portion 22 from which the flexible member 21 projects. The ink stored in the ink storage unit 78 is supplied to the device on the downstream side from the outlet 13.

The damper device 70 of the present embodiment has a shape having a width larger than a height, as illustrated in FIG. 9B. The height of the damper device 70 can be reduced by lowering a bending rate at a top portion 24 of the flexible member 21. Therefore, a printer itself can be miniaturized, and installation thereof in a thin-type inkjet printer for mobile application is easy.

Note that, in a case where the damper device 70 as described above is to be mounted on the carriage, the damper device 70 may be stacked in the vertical direction. Alternatively, the damper device 70 may be juxtaposed in the horizontal direction.

Figure 9C:
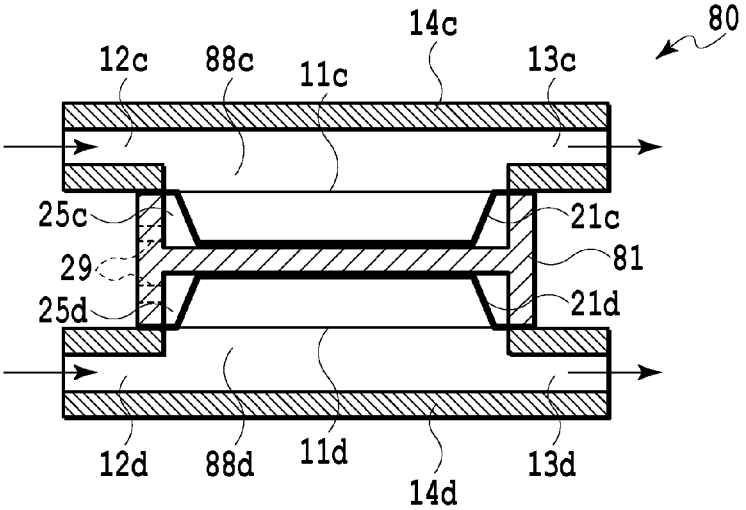
FIG. 9C is a cross-sectional view of the damper device.

Moreover, as illustrated in FIG. 9C, the two damper devices may be integrated and miniaturized by combining them so that the projecting portions of the flexible members 21 face each other and project. The molded flexible member 21*c* is inserted through the opened upper surface 11*c* of an ink container 81, and the sleeve portion 23*c* and the top portion 24*c* of the flexible member 21*c* are joined to the ink container 81. Note that the top portion 24*c* is joined to the surface 26*c* on an inner side of the ink container 81. Similarly, the molded flexible member 21*d* is inserted through the opened lower surface 11*d* of the ink container 81 and joined to the ink container 81 to thereby form an ink storage unit 88*d*.

In the damper device 80, the ink flows into the each of the ink storage units through two inlets 12*c* and 12*d* and flows out from outlets 13*c* and 13*d* through the ink storage units 88*c* and 88*d*. The oscillating pressure fluctuation propagating from the supply tube during ejection is individually absorbed/damped by the three-dimensional flexible members 21*c* and 21*d* of the damper device 80, respectively, and the propagation to the downstream of the damper device 80 is reduced.

Sixth Embodiment

Figure 11A:
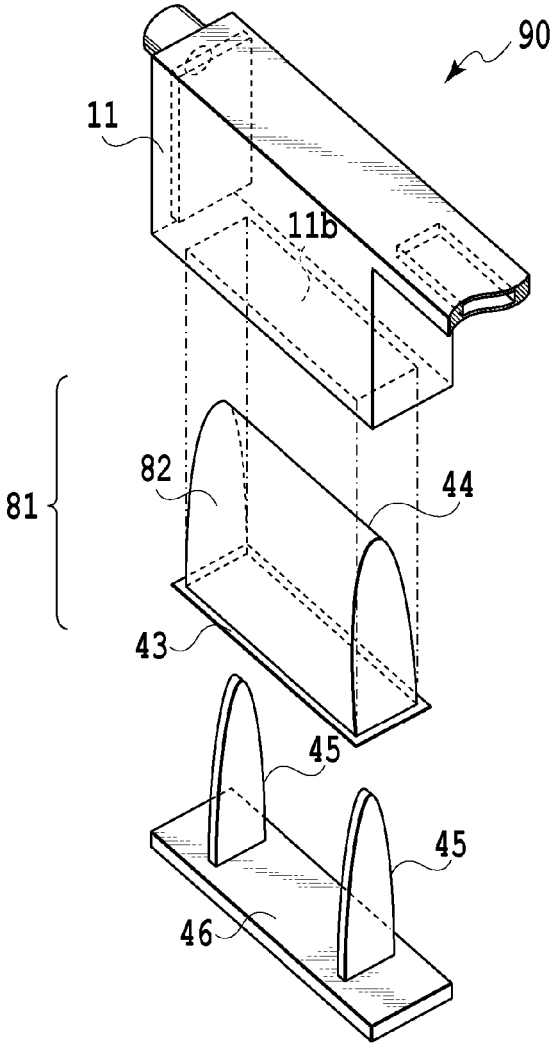
FIG. 11A is a perspective view illustrating the damper device.
Figure 11B:
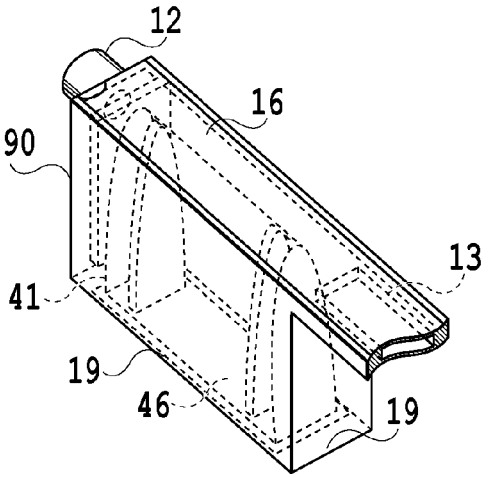
FIG. 11B is a perspective view illustrating the damper device.
Figure 12A:
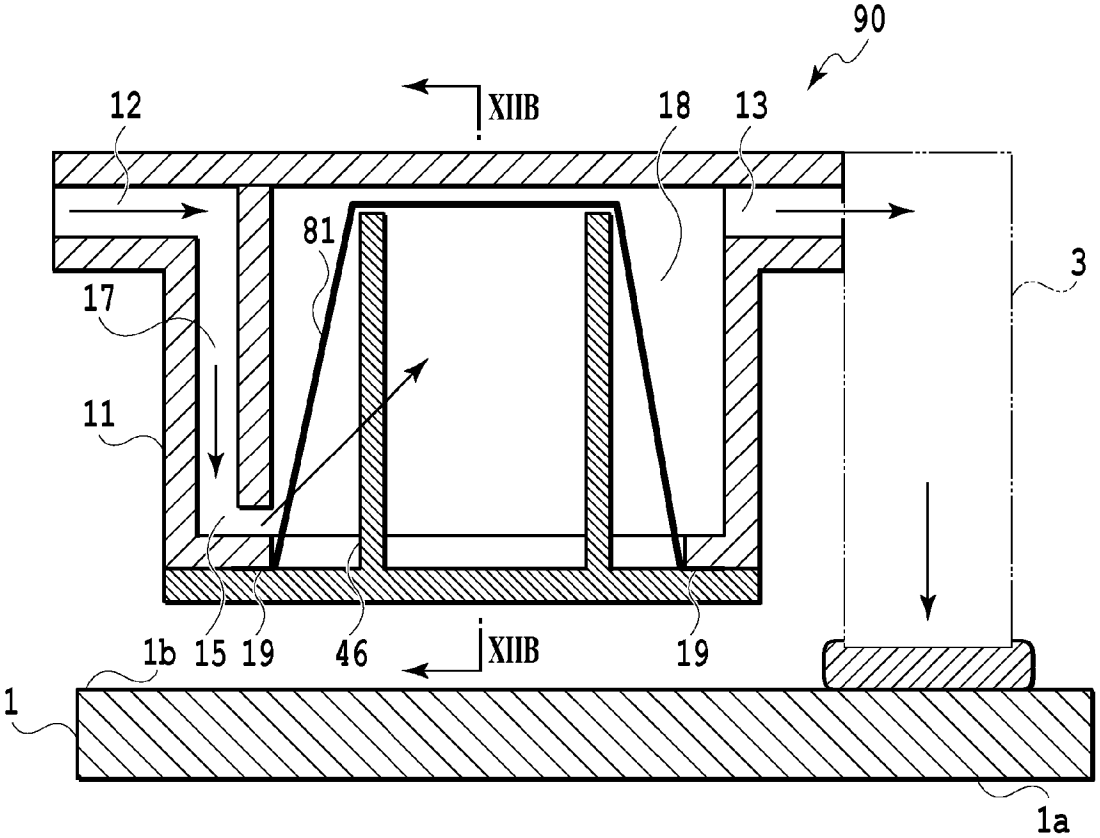
FIG. 12A is a cross-sectional view of the damper device.
Figure 12B:
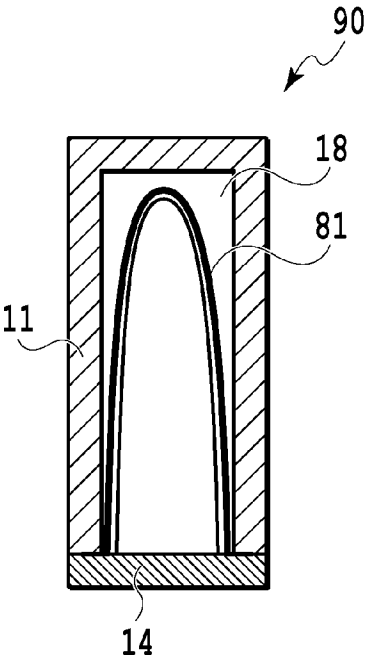
FIG. 12B is a cross-sectional view of the damper device.

Hereinafter, a sixth embodiment of the present invention will be described by referring to the drawings. FIGS. 11A and 11B are perspective views illustrating a damper device 90 in the present embodiment, FIG. 12A is a cross-sectional view of the damper device 90, and FIG. 12B is a cross-sectional view on XIIB-XIIB of FIG. 12A. The damper device 90 includes the inlet 12 and the outlet 13, and the ink flowing in from the inlet 12 flows out from the outlet 13 through the damper device 90. The ink flowing out from the outlet 13 is supplied to the liquid ejecting head 1.

The damper device 90 includes a flexible member 81 which is a member stored in the box-shaped ink container 11 whose lower surface 11*b* is open and the ink container 11 and which is molded into a projecting shape, a projection member 46, and the ink container 11. The sleeve portion 43 of the flexible member 81 on which a projecting portion 82 is formed is heat-welded to an edge of the ink container 11. Then, the sleeve portion 43 is welded to the projection member 46. The projection member 46 includes a plurality of projection portions 45, and this projection portion 45 is inserted into the projecting portion 82 of the flexible member 81 and maintains a convex shape of the flexible member 81.

The ink container 11 is formed of polypropylene (PP). The open lower surface 11*b* of the ink container 11 is sealed by the projection member 46 by sandwiching the sleeve portion of the flexible member 81. Note that the four ink containers 11 and the air-bubble trap device 3 connected to the outlet 13 of the damper device 2 may be integrally molded, and the air-bubble trap device 3 and the four damper devices may be formed all at once by joining one projection member.

The flexible member 81 is a laminated body obtained by laminating different types of materials as described below via an adhesive layer, and a surface of polypropylene (PP) of the flexible member 81 is joined to the ink container 11.

polyethylene terephthalate (PET): 12 μm
nylon (NY): 16 μm
polypropylene (PP): 26 μm Note that a welded layer made of silicon (Si) is formed on a surface of the polyethylene terephthalate (PET) layer on the nylon (NY) side.

The inlet 12 is provided on an inlet end portion of the vertical passage 17 extending in a vertical direction to the vicinity of the lower surface of the ink container 11. Moreover, the outlet 13 is provided at a position facing the inlet 12 in the vicinity of the ceiling portion of the ink container 11.

The flexible member 81 is inserted through the open lower surface 11*b* of the ink container 11, the projection member 46 is inserted into the projecting portion 82 of the flexible member 81, and the projecting shape of the projecting portion 82 is maintained by the inserted projection member 46. The sleeve portion 43 of the flexible member 81 is joined to the periphery of the lower surface 11*b* of the ink container 11 and the projection member 46 by heat-welding, and is sealed. Accordingly, the ink storage unit (liquid storage unit) 18 is formed between the inner surface of the ink container 11 and the outer surface of the flexible member 81. That is, the flexible member 81 forms a part of the ink storage unit 18.

An arrow in FIG. 12A indicates a flow of the ink in the damper device 90. The ink enters the inside of the damper device through the inlet 12 and is supplied from a lower part of the damper device 90 to the ink storage unit 18 through the vertical passage 17 communicating with the inlet 12. The ink is supplied to the ink storage unit 18 and is stored in contact with the outer surface of the projecting portion 82 from which the flexible member 81 projects. The ink supplied to the ink storage unit 18 is discharged from the damper device 90 through the outlet 13 at an upper part of the damper device 90. In a case where air bubbles are generated (flow) in the ink storage unit 18, the air bubbles floating above the ink storage unit 18 is discharged from the outlet 13 at the upper part.

Fluctuation of an oscillating pressure of the ink propagating from the supply tube 6 in a case where a dynamic pressure is generated in the ink in the tube, due to an inertia force caused by movement of the carriage 4 during ink ejection, is absorbed and damped by deflection of the flexible member 81 of the damper device 90, and the propagation of the dynamic pressure to a downstream of the damper device 90 is reduced.

The surface of the flexible member 81 on the projecting side is constituted so as to have polypropylene (PP), and a sleeve portion 44 and the ink container 11 are brought into contact so that the surfaces made of polypropylene (PP) thereof are in contact with each other, and are joined by heat welding. The ink container 11, the flexible member 81, and the projection member 46 are heat-welded by the heat welding unit 19, and the welding is all made by planar welding, whereby highly reliable sealing property can be obtained.

The damper device 90 of the present embodiment absorbs the pressure fluctuation of the ink on the surface of the projecting portion 82 of the flexible member 81 whose convex shape is three-dimensionally maintained by the projection member 46. As described above, a pressure-absorbing surface can be formed with a relatively large area in a small space by forming the flexible member 81 in a convex shape in the ink container 11. Furthermore, the projecting portion 82 is formed by projecting the flexible member 81, and the flexible member on a facing surface formed by being projected is deflected in accordance with the dynamic pressure of the ink.

As a result, while the sufficient area capable of absorbing the dynamic pressure of the ink is ensured, the reduction in a projection area of the flexible member 81 viewed from a front (upper part in FIG. 4A) realizes miniaturization of the damper device 90, and a large number of the high-performance damper devices 90 can be mounted on the carriage with a limited space. Furthermore, since the shape of the projecting portion 82 is maintained by the projection portion 45 of the projection member 46, the flexible member 81 can maintain the convex shape without large deformation even in a case where a strong negative pressure acts on the ink due to a suction restoring operation and the like. Accordingly, there is no concern that the performance of absorbing the pressure fluctuation of the ink deteriorates.

Moreover, the action of agitating the ink in the ink container 11 can be obtained by deformation of the flexible member 81. Accordingly, the ink is suitable for a printer using, for example, pigment ink or the like, in which the ink component can be easily biased in a case where the ink is left for a long time.

In addition, the hollow portion constituted by the flexible member 81 and the projection member 46 inside the ink container 11 has a higher absorbing effect of the pressure fluctuation in a case of being open to the atmospheric air. In the case of being open to the atmospheric air, it becomes possible to open to the atmospheric air by providing an atmospheric air communication hole in a lid portion of the projection member 44 for the ink container 11.

Furthermore, since the projecting portion 82 of the flexible member 81 is stored in the ink container 11, there is a small risk that the flexible member 81 is accidentally broken during assembling of the liquid ejecting device.

The liquid ejecting device may be filled with storage ink exclusively for physical distribution in a supply system during the physical distribution. In this case, at start of use of the liquid ejecting device, the storage ink needs to be replaced by ink for recording. Since, in the damper device 90 in the present embodiment, the vertical passage 17 communicating with the inlet is located at the lower part, while the outlet 13 is located at the upper part and at the diagonal position of the vertical passage 17, ink replacement in the ink storage unit 18 is easy.

Note that the inlet 12 and the outlet 13 of the damper device 90 are not limited to the positions of the present embodiment. Moreover, the projection member 46 may have another three-dimensional shape as long as the projecting convex shape of the flexible member 81 can be maintained.

Furthermore, a material of the flexible member may be selected in view of ink resistance, gas barrier performance, and damping performance as long as the material is a thermally extendable material. In addition, a material of the ink container 11 may be selected in view of ink resistance and gas barrier performance.

Furthermore, the liquid ejecting device capable of using the ink of four colors has been described as an example in the present embodiment, but the number of ink colors is not limited to four.

Moreover, the shape and the surface area of the flexible member inside the damper device in a certain color may be different from those of the others, depending on required damping performance.

Furthermore, the damper device 90 may have the projecting portion of the flexible member in the ink container, downward in the vertical direction. In addition, the damper device of the present embodiment may be used in a sideways-falling attitude.

Moreover, the damper device 2 may be arranged in an attitude in which the device is vertically inverted and the projecting portion of the flexible member 81 is directed downward, or the damper device 2 may be arranged in an attitude in which the projecting portion is directed to a sub-scanning direction by bringing the damper device into a state of falling sideways.

As described above, the damper device is provided with the projection member including the projection portion forming the flexible member in the convex shape, and the flexible member forming a part of the ink storage unit. Accordingly, the dynamic pressure of the liquid can be sufficiently absorbed while the miniaturization of the device body is achieved, and thus the liquid ejecting device including the damper device easily manufactured was able to be realized.

Seventh Embodiment

Hereinafter, a seventh embodiment of the present invention will be described by referring to the drawings. Note that, since a basic configuration of the present embodiment is similar to that of the sixth embodiment, only a characteristic configuration will be described below.

Figure 13A:
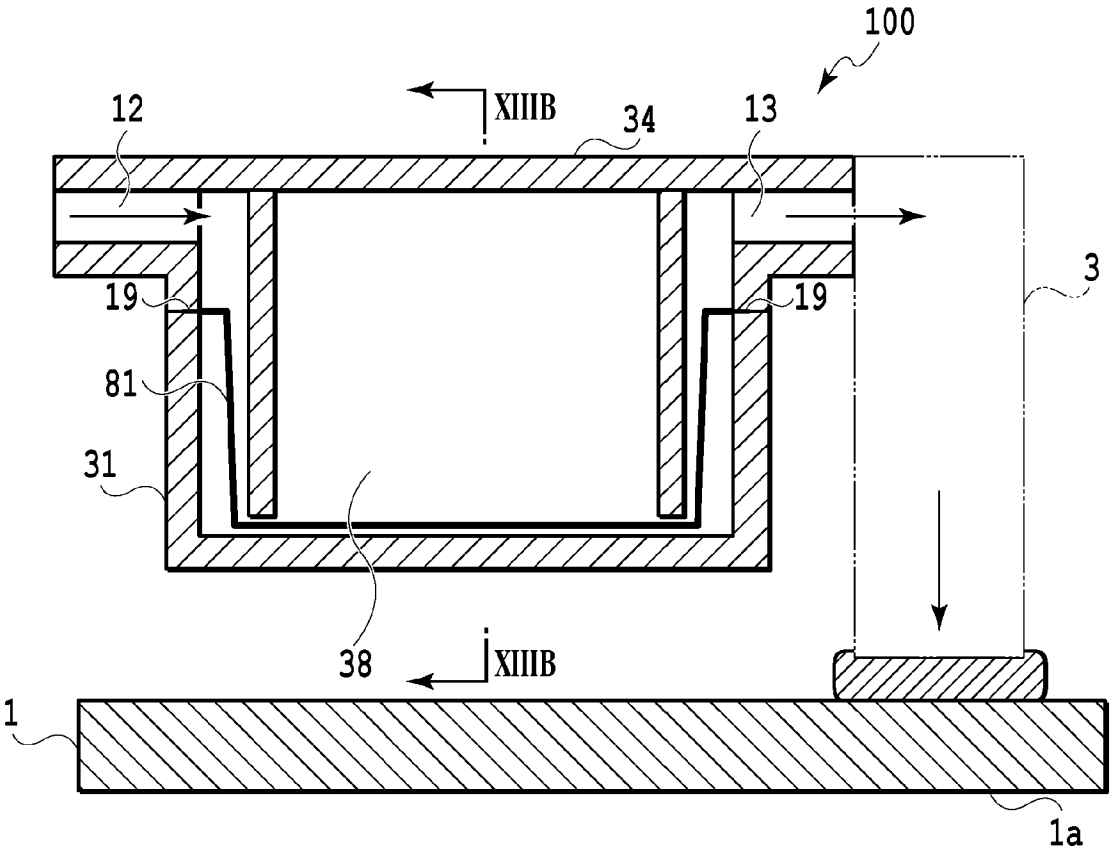
FIG. 13A is a cross-sectional view of the damper device.
Figure 13B:
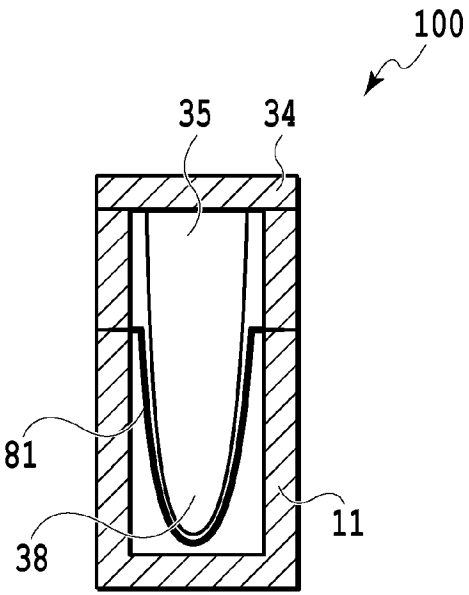
FIG. 13B is a cross-sectional view of the damper device.

FIG. 13A is a cross-sectional view of a damper device 100 of the present embodiment, and FIG. 13B is a cross-sectional view on XIIIB-XIIIB of FIG. 13A. An upper part of an ink container 31 of the damper device 100 is open, and the flexible member 81 and a projection member 34 are inserted through the open upper part. The flexible member 81 is inserted into the ink container 31 so as to form a projecting portion on a lower part by the projection portion 35 of the projection member 34. In the damper device 100 of the present embodiment, the ink storage unit 38 is formed in a portion where the projection member 34 is inserted inside the inserted flexible member 81. The ink having flowed into the damper device 100 through the inlet 12 is supplied to the ink storage unit 38, and is stored in contact with an inner surface of the projecting portion 22 from which the flexible member 81 projects.

The ink stored in the ink storage unit 38 flows out from the outlet 13, and is supplied to the device on the downstream side.

Along with inflow of the ink, in a case where the air bubbles enter the ink storage unit 38, the air bubbles float to the upper part of the ink storage unit 38 and are easily discharged from the outlet 13 on the upper part to the downstream side. In the present embodiment, the ink flows while being in contact with the projection member 34 inside the flexible member 81.

In the sixth embodiment, in the flexible member 81 forming a part of the ink storage unit 38, a ratio occupied by the flexible member 81 in the ink storage unit 38 is small, but in the present embodiment, the ratio occupied by the flexible member 81 in the ink storage unit 38 is larger than that in the sixth embodiment. Therefore, it is easier to deflect the flexible member 81 in accordance with fluctuation of the ink pressure in the present embodiment than in the sixth embodiment. Accordingly, a shape design of the projection portion 35 of the projection member 34 with higher freedom is possible in view of ink replacement performance, filling performance, efficient flow, measures against sedimentation, bubble erasing performance and the like in consideration of ink characteristics and the like.

Eighth Embodiment

Hereinafter, an eighth embodiment of the present invention will be described by referring to the drawings. Note that, since a basic configuration of the present embodiment is similar to that of the sixth embodiment, only a characteristic configuration will be described below.

Figure 14A:
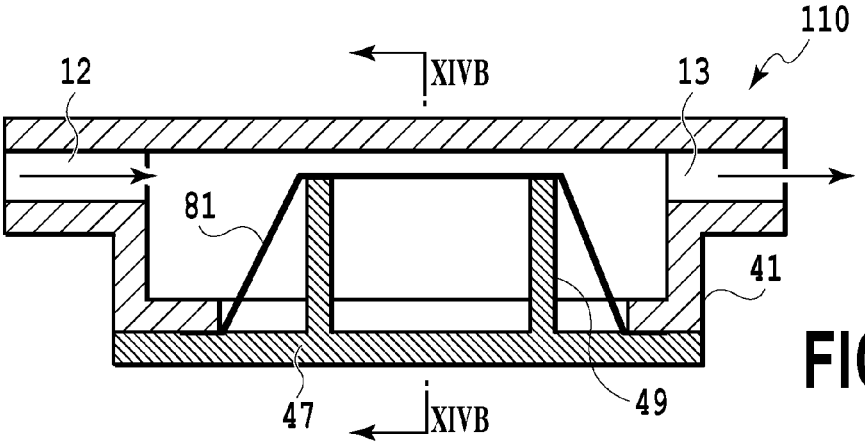
FIG. 14A is a cross-sectional view of the damper device.
Figure 14B:
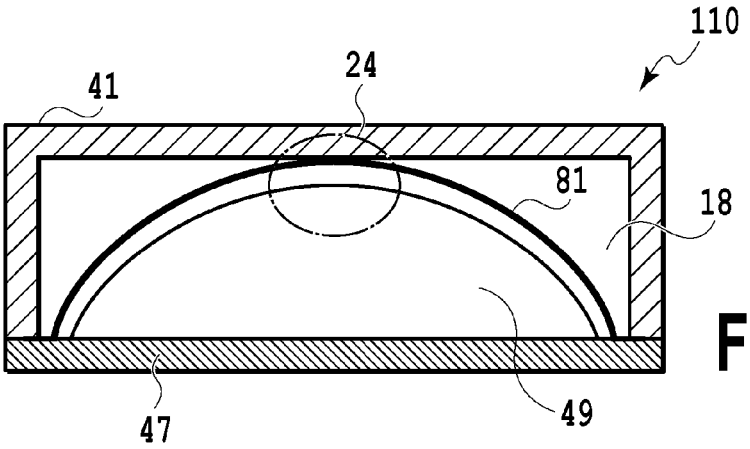
FIG. 14B is a cross-sectional view of the damper device.

FIG. 14A is a view illustrating a cross section of a damper device 110 of the present embodiment, and FIG. 14B is an XIVB-XIVB cross section of FIG. 14A. The ink container 41 of the damper device 110 in the present embodiment is opened at its lower part similarly in the sixth embodiment, and the flexible member 81 and the projection member 47 are inserted through the lower part opened.

The damper device 110 of the present embodiment has a shape having a width larger than a height, as illustrated in FIG. 14B. The height of the damper device 110 can be reduced by lowering a curvature at a top portion 24 of the flexible member 81. Therefore, a printer itself can be miniaturized, and installation thereof in a thin-type inkjet printer for mobile application is easy.

Note that, in a case where the damper device 110 as described above is to be mounted on the carriage, the damper device 110 may be stacked in the vertical direction. Alternatively, the damper device 110 may be juxtaposed in the horizontal direction.

Figure 14C:
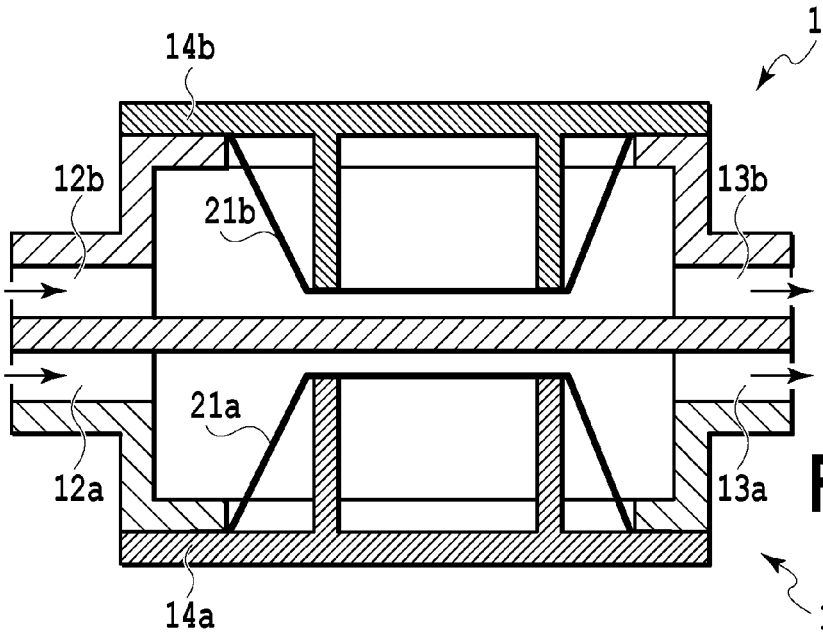
FIG. 14C is a cross-sectional view of the damper device.

Moreover, as illustrated in FIG. 14C, the two damper devices 110 may be integrated and miniaturized by combining them so that the projecting portions 49 of the flexible members 47 face each other and project. The fluctuating pressure propagating from the supply tube during ejection is individually absorbed/damped by the three-dimensional flexible members 81*a* and 81*b* of the damper device 110, respectively, and propagation of the fluctuating pressure to the downstream of the damper device 110 is reduced.

Other Embodiments

Figure 15A:
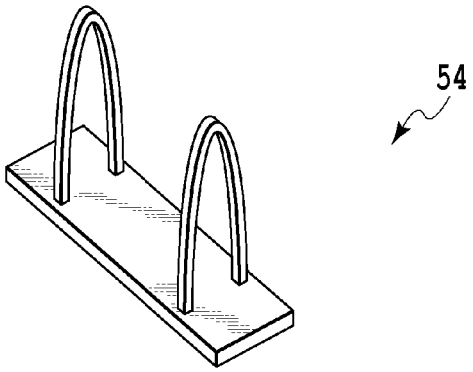
FIG. 15A is a view illustrating a projection member.
Figure 15B:
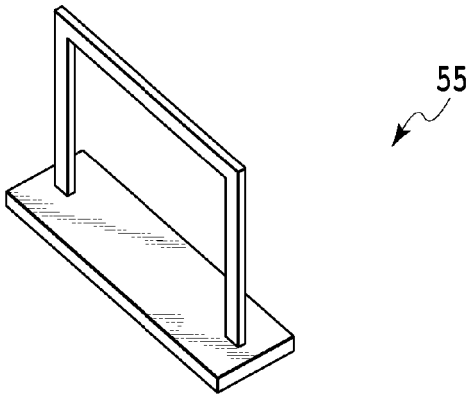
FIG. 15B is a view illustrating the projection member.
Figure 15C:
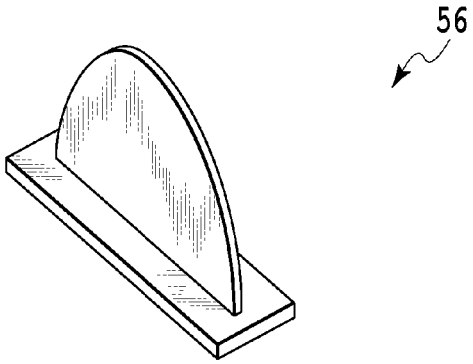
FIG. 15C is a view illustrating the projection member.

FIGS. 15A to 15C are views illustrating projection members in other embodiments of the present invention. As illustrated in FIGS. 15A and 15B, the projection members 54 and 55 do not have plate-shaped projection portions but their outer shapes are formed by frames. Moreover, a projection member 56 includes a single plate-shaped projection member as illustrated in FIG. 15C. The damper device may include the projection members as them.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2015-163936, filed Aug. 21, 2015, and No. 2015-163965, filed Aug. 21, 2015, which are hereby incorporated by reference wherein in their entirety.

What is claimed is:

1. A liquid ejecting device comprising:

a liquid containing portion which contains liquid;

a liquid storage unit for containing the liquid supplied from the liquid containing portion;

a first space disposed in the liquid storage unit, having a damper function, and defined by an inner surface of a flexible member having a convex portion and a bottom surface of the liquid storage unit;

a second space which is disposed in the liquid storage unit and in which liquid is stored, the second space being defined by an outer surface of the flexible member and a side surface and a top surface of the liquid storage unit;

a tube which connects the liquid storage unit and the liquid containing portion;

a liquid ejecting head ejecting the liquid supplied from the liquid storage unit; and a carriage that carries the liquid storage unit and the liquid ejecting head and moves in a first direction;

wherein the first space is not supplied with the liquid and the second space is supplied with the liquid.

2. The device according to claim 1, wherein the convex portion of the flexible member is welded to the top surface.

3. The device according to claim 1, wherein the bottom surface has a projecting member, and the convex portion of the flexible member is held by the projecting member.

4. The device according to claim 3, wherein the projecting member includes a plurality of projection portions, each projection portion being a plate-shaped projection portion.

5. The device according to claim 1, wherein the liquid storage unit and the convex portion are formed longer in a second direction intersecting the first direction than in the first direction, and the ink supplied from the liquid containing portion flows along the second direction in the liquid storage unit.

6. The device according to claim 1, wherein the top surface is composed of a flexible film.

7. The device according to claim 1, wherein the liquid storage unit has an inlet for supplying liquid from the liquid containing portion and an outlet for supplying liquid to the liquid ejecting head, the inlet and the outlet being closer to the top surface than the bottom surface.

8. The device according to claim 1, wherein the flexible member is formed of a film of a laminated body.

9. The device according to claim 1, wherein two liquid storage units are provided, and wherein the two liquid storage units are combined and integrally formed so that projecting portions from which the flexible members project in the respective liquid storage units face each other and project.

10. The device according to claim 1, wherein fluctuation of an oscillating pressure of liquid propagating from the tube, in a case where a dynamic pressure is generated in the liquid in the tube due to movement of the carriage, is absorbed and damped by deflection of the flexible member.

* * * * *